United States Patent [19]

Iijima

[11] 4,272,657

[45] Jun. 9, 1981

[54] KEYBOARD ASSEMBLY FOR ELECTRONIC MUSICAL INSTRUMENTS

[75] Inventor: Masakatsu Iijima, Hamamatsu, Japan

[73] Assignee: Nippon Gakki Seizo Kabushiki Kaisha, Japan

[21] Appl. No.: 6,178

[22] Filed: Jan. 24, 1979

[30] Foreign Application Priority Data

| | | | |
|---|---|---|---|
| Jan. 26, 1978 | [JP] | Japan | 53-7297[U] |
| Jan. 26, 1978 | [JP] | Japan | 53-7298[U] |
| Jan. 26, 1978 | [JP] | Japan | 53-7299[U] |
| Jan. 26, 1978 | [JP] | Japan | 53-7300[U] |
| Jan. 26, 1978 | [JP] | Japan | 53-7301[U] |
| Jan. 26, 1978 | [JP] | Japan | 53-7302[U] |
| Jan. 26, 1978 | [JP] | Japan | 53-7303[U] |

[51] Int. Cl.[3] ..... H01H 13/70; G10C 3/12

[52] U.S. Cl. ..... 200/5 A; 84/423 R; 84/DIG. 7

[58] Field of Search ..... 200/5 R, 5 A, 5 E, 1 R, 200/1 A; 361/397, 398, 399, 400, 417; 84/1.01, 423 R, 423 A, 423 B, 432, 433, DIG. 7, 434

[56] References Cited

U.S. PATENT DOCUMENTS

| | | | |
|---|---|---|---|
| 3,251,923 | 5/1966 | Lund | 200/1 R X |
| 3,657,460 | 4/1972 | Cutler | 84/434 X |
| 3,797,357 | 3/1974 | Thomas et al. | 84/423 |
| 4,186,638 | 2/1980 | Iijima | 84/DIG. 7 |

*Primary Examiner*—James R. Scott

*Attorney, Agent, or Firm*—Ostrolenk, Faber, Gerb & Soffen

[57] ABSTRACT

A keyboard assembly for electronic musical instruments such as electronic pianos is constructed from a key switch unit and a resilient holder block for mounting the key switch unit to a key frame via simple snap coupling. The key switch unit includes a resiliently deformable movable contact common to all keys in combination with given printed circuits including a plurality of fixed contacts so that, when any key is depressed, the movable contact is locally depressed by an actuator accompanying the key and brought into provisional contact with a corresponding fixed contact in order to selectively switch on a corresponding printed circuit for generation of a musical tone.

40 Claims, 22 Drawing Figures

KEYBOARD ASSEMBLY FOR ELECTRONIC MUSICAL INSTRUMENTS

BACKGROUND OF THE INVENTION

The present invention relates to improved keyboard assembly for electronic musical instruments, and more particularly relates to improvement in construction of a keyboard assembly for electronic musical instruments such as electronic organs in which depression of a key causes engagement between movable and fixed contact in order to selectively switch on a corresponding electric circuit for generation of a corresponding musical tone.

In the construction of the conventional keyboard assembly of the above-described type, a movable contact given in the form of a leaf spring is provided for each key and a fixed contact common to all keys is arranged below the movable contacts. When any key in the keyboard is depressed during performance on the musical instrument, its associated bottom actuator thrusts down a corresponding movable contact into provisional contact with a corresponding portion of the fixed contact and a corresponding electric circuit is switched on for generation of a musical tone.

In this case, it is necessary to register a number of movable contacts at correct positions on a key frame with high mechanical preciseness. This assembly work is considerably complicated and, therefore, very time and labor consuming. Use of a in number of movable contacts inevitably results in great increase in the number of mechanical and electrical parts. Further, use of the leaf spring type movable contact tends to generate undesirable chattering during engagement between the movable and fixed contacts which fatally degrades acoustic effect of the musical tones to be generated. In addition, use of a plurality of movable contacts in the circuits makes it impossible to use the printed circuit technique in construction of the keyboard assembly which is effective for building a compact construction.

SUMMARY OF THE INVENTION

It is one object of the present invention to simplify the assembly work of a keyboard assembly for electronic musical instruments.

It is another object of the present invention to reduce time and labor necessary for construction of a keyboard assembly for electronic musical instruments.

It is another object of the present invention to reduce the number of mechanical and electrical parts necessary for construction of a keyboard assembly for electronic musical instruments.

It is a further object of the present invention to prevent generation of undesirable chattering of a keyboard assembly for electronic musical instruments during generation of musical tones.

It is yet a further object of the present invention to enable introduction of the printed circuit technique into construction of a keyboard assembly for electronic musical instruments, thereby assuring a compact construction of the assembly.

In accordance with the basic concept of the present invention, the keyboard assembly is constructed from a key switch unit and a resilient holder block for mounting the key switch unit to a key frame via a simple snap coupling. The key switch unit includes given printed circuits formed on a base board while including a plurality of fixed contacts, and a resiliently deformable movable contact common to all keys. When a key is not depressed, the corresponding movable contact is held in position above the fixed contact and the printed circuit is not switched on. Upon depression of any key, its associated actuator thrusts down a corresponding portion of the movable contact and brings the portion in provisional contact with a corresponding fixed contact on the base board. Then, a corresponding printed circuit on the base board is switched on for generation of a musical tone.

DESCRIPTION OF THE PREFERRED EMBODIMENTS

Figure 1:
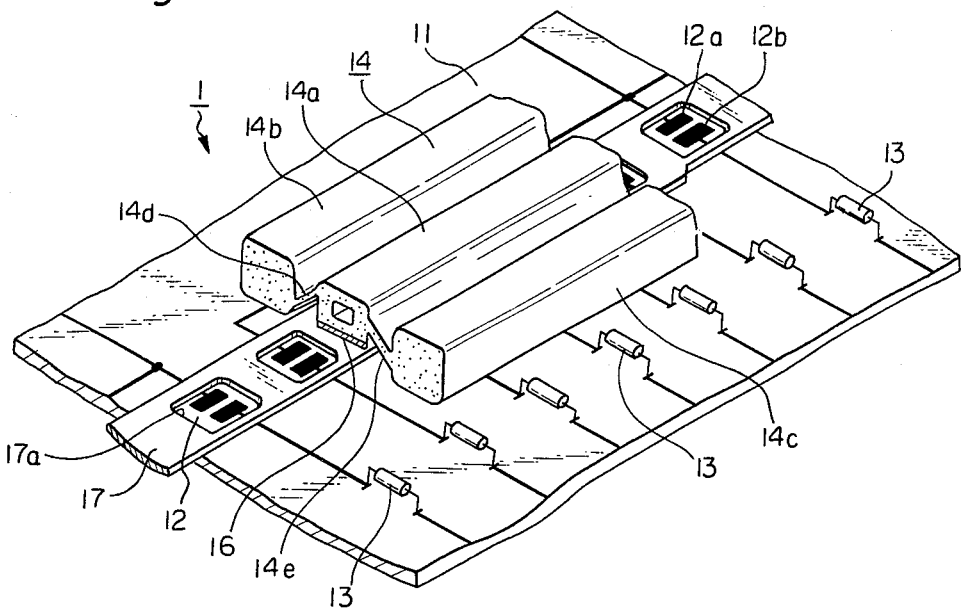
FIG. 1 is a perspective view of a part of an embodiment of the key switch unit used in the keyboard assembly in accordance with the present invention.

In the following description, mechanical and/or electrical parts substantially same in construction and operation and common to different embodiments are designated with common reference numerals and symbols.

One embodiment of the key switch unit is shown in FIG. 1, which is advantageously used for the keyboard assembly in accordance with the present invention as hereinafter described in more detail. The key switch unit 1 includes a printed circuit base board 11 on which a prescribed electric circuit is printed. A plurality of fixed contacts 12 of the circuit are formed on the top surface of the base board 11 while being spaced from each other along the length of the base board 11 at intervals corresponding to those of keys (not shown) in the keyboard. Each fixed contact 12 is made up of a pair of electrodes 12*a* and 12*b* which are closely spaced from each other. The electrodes 12*a* in the same octaves are collectively connected to each other whereas the other electrodes 12*b* for common notes are collectively connected via diodes 13 to each other.

A movable contact 14 is mounted on the base board 11 and extends over the entire width of the keyboard. The movable contact 14 comprises a pair of holding sections 14*b* and 14*c*, a hollow switching section 14*a* arranged between the holding sections 14*b* and 14*c*, and a pair of connecting sections 14*d* and 14*e* for connecting the switching section 14*a* to the holding sections 14*b* and 14*c*, all sections 14*a* to 14*e* extending substantially parallel to each other. The switching section 14*a* is provided on its bottom face with electrodes 16 which are separated from each other, for example, at the borders between octaves.

A spacer 17 extending over the entire width of the keyboard is interposed between the switching section 14*a* of the movable contact 14 and the printed circuit base board 11. At positions corresponding to the fixed contacts 12 on the base board 11, the spacer 17 is provided with square apertures 17*a* for selective contact of any electrode 16 with any fixed contact 12. Thus, the spacer 17 holds the electrodes 16 spacedly apart from the electrodes 12*a*, 12*b* of the fixed contact 12 in the non-depressed state of the keys. Spacer 17 is shown only in FIG. 1, although it can, if desired, be included in the other preferred embodiments illustrated in the drawings as well.

The electrode 16 on the movable contact 14 is made of an electrically conductive resilient material such as electrically conductive rubber whereas the spacer 17 is made of an electrically non-conductive material. The movable contact 14 is made of a resilient material such as rubber.

As later described in more detail, the above-described key switch unit 1 is incorporated into the keyboard assembly via a holder block 2 which is shown in detail in FIGS. 2 and 3. The holder block 2 includes first and second holding sections 21 and 22 for the printed circuit base board 11 which are connected in one body to each other by connecting sections 23. The holder block 2 is preferably formed in one integral body by synthetic resin molding. The first holding section 21 is provided with a vertical face 21*a* which extends almost over the entire length of the printed circuit base board 11. A horizontally elongated groove 21*b* is formed in the vertical face 21*a* of the first holding section 21, which has a width almost equal to the thickness of the printed circuit base board 11.

Each second holding section 22 takes the form of a vertical column which is almost semi-circular in transverse cross section and coupled to the vertical face 21*a* via one of the connecting sections 23. A peripheral rim 22*a* is formed on the side of the second holding section 22 opposite to the first holding section 21. At a position somewhat below the rim 22*a*, a U-shaped arm 22*c* extends outwards from the second holding section 22 and carries a locking projection 22*b* formed on the top face thereof. A plurality of second holding sections 22 are provided along the length of the first holding section 21 at properly selected intervals. A pair of threaded holes 24 are formed vertically through the holding sections 21 and 22 in alignment with each other. Small vertical projections 24*a* are formed in each threaded hole 24 in order to stably clamp set screws therein when the holder block 2 is coupled to the keyboard assembly as hereinafter described in more detail.

The printed circuit base board 1 in this embodiment is provided with a pair of vertical holding walls 18*a* and 18*b* which are spaced parallel to each other and extend over at least the entire length of the movable contact 14. The distance between the holding walls 18*a* and 18*b* is designed so that, when the movable contact 14 is placed between the holding walls 18*a* and 18*b*, the electrodes 16 on the bottom of the switching section 14*a* are spaced upwards from the fixed contact electrodes 12*a* and 12*b* on the base board 11. The base board 1 is further provided with apertures 19 for reception of the second holding sections 22 of the holder block 2. The above-described holding walls 18*a* and 18*b* may be formed separately from the base board 11 and mounted to the latter by means of bonding or snap coupling. The holding walls 18*a* and 18*b* may be formed in integral one body with the base board 11 by synthetic resin molding.

In order to assemble the printed circuit base board 11 with the holder block 2, the second holding sections 22 of the holder block 2 are inserted in the apertures 19 of the base board 11, the one edge of the base board 11 is inserted into the groove 21*b* of the first holding section 21, and the locking projections 22*b* are inserted into corresponding apertures 15 formed through the base board 11. Engagement of the locking projection 22*b* with the aperture 15 effectively blocks relative horizontal movement between the printed circuit base board 11 and the holder block 2. Clamping of the printed circuit base board 11 between the rim 22*a* and the arm 22*c* of the second holding section 22 effectively prevents relative vertical movement between the printed circuit base board 11 and the holder block 2. Next, the movable contact 14 is forcedly placed between the pair of holding walls 18*a* and 18*b* by snap coupling, the holding sections 14*b* and 14*c* being placed in resilient pressure contact with the holding walls 18*a* and 18*b*. The electrodes 16 on the bottom of the switching section 14*a* are held somewhat above the electrodes 12*a* and 12*b* as shown in FIG. 2, if no spacer is arranged between the fixed contact electrodes 12*a*, 12*b* and the movable contact electrodes 16.

Figure 2:
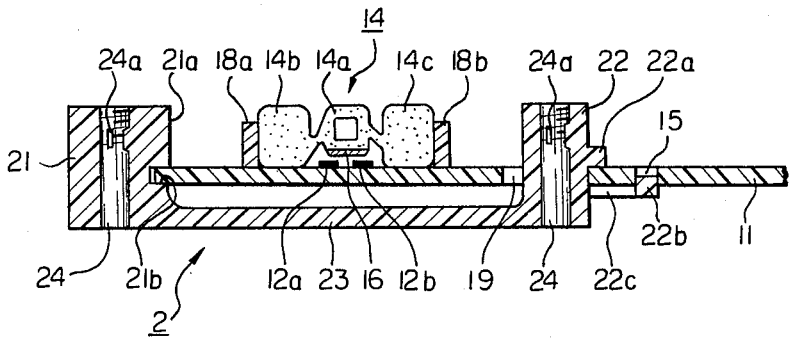
FIG. 2 is a side sectional view of one embodiment of the key switch unit and the holder block in the assembled state, which are used for the keyboard assembly in accordance with the present invention.
Figure 3:
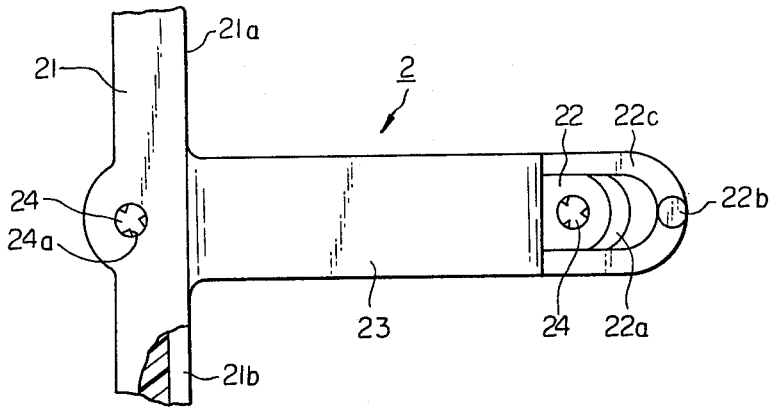
FIG. 3 is a plan view, partly in section, of one embodiment of the holder block in accordance with the present invention.
Figure 4:
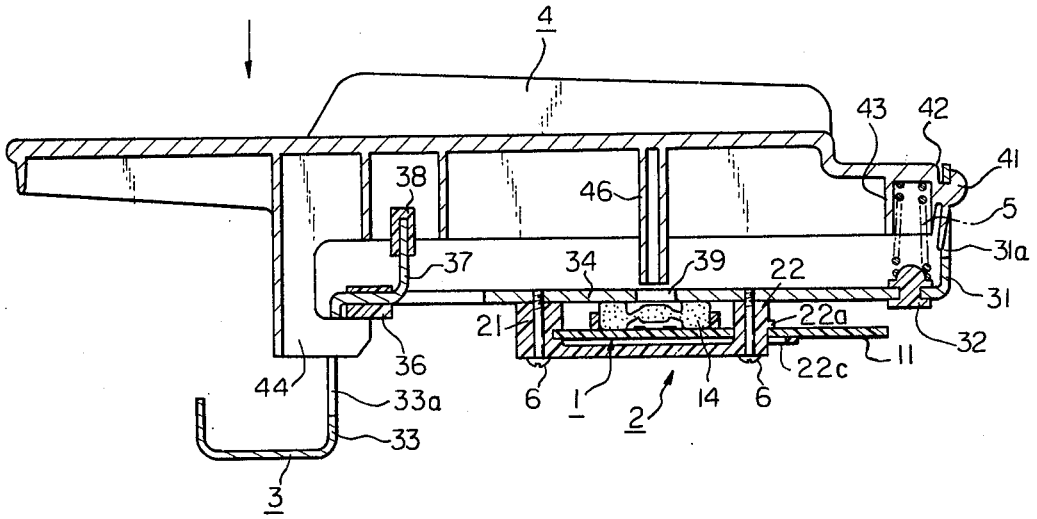
FIG. 4 is a side view of one embodiment of the keyboard assembly in accordance with the present invention in which the key switch unit shown in FIG. 1 is used in combination with the holder block shown in FIGS. 2 and 3, FIGS. 5A through 5D are side sectional views of various modifications of the holder block shown in FIGS. 2 and 3.

One embodiment of the keyboard assembly in accordance with the present invention is shown in FIG. 4, in which the key switch unit 1 shown in FIG. 1 is used in combination with the holder block 2 shown in FIG. 3, both being assembled together as shown in FIG. 2. A keyboard frame 3 extends horizontally in a direction substantially perpendicular to the width of the keyboard and has an upwardly bent rear vertical extension 31 having a window 31*a* near the top end thereof. At a position near the rear vertical extension 31, the frame carries an upwardly projecting spring seat 32 which is preferably made of a resilient material for convenience in mounting via snap coupling. The frame 3 is further provided with a downwardly bent front vertical extension 33 having a window 33*a*. Both vertical extensions 31 and 33 are connected to each other by a horizontal section 34.

A key 4 has a rear end portion 41 which is in engagement with the above-described rear vertical extension 31 of the frame 3 at the window 31*a*. The rear end portion 41 has a top recess 42 in which the top end portion of the rear vertical extension 31 engages. At a position near the rear end portion 41, a cylindrical projection 43 is formed extending downwards from the bottom of the key 4 in order to act as a spring seat. A compression spring 5 is inserted between the two spring seats 32 and 43 in order to resiliently thrust the rear end portion 41 of the key 4 upwards.

At a position near the front vertical extension 33, a stopper piece 36 is mounted on the frame 3 and an L-shaped downward extension 44, which passes through the window 33*a* of the front vertical extension 33, is in resilient pressure contact with the stopper piece 36 due to the repulsion by the spring 5, in order to maintain the key 4 in the substantially horizontal state. Just on the back side of the stopper piece 36, the frame 3 has an upwardly bent front vertical extension 37 which carries guide pieces 38 in order to limit horizontal swing of the key 4 when depressed during performance of the musical instrument. The stopper piece 36 and the guide piece 38 are both preferably made of a resilient material such as rubber.

The holder block 2 carrying the key switch unit 1 is fixed to the bottom of the horizontal section 34 of the frame 3 by means of set screws 6 received in the threaded holes 24 of the holder block 2 (see FIG. 2), the holding sections 14*b* and 14*c* of the movable contact 14 being brought into pressure contact with the bottom face of the horizontal section 34.

At a position corresponding to the switching section 14*a* of the movable contact 14, a slot 39 is formed through the horizontal section 34 of the frame 3. Further, at a position corresponding to the slot 39 of the frame 3, the key 4 is provided with an actuator 46 which extends downwards from the bottom of the key 4. The length of the actuator 46 is designed so that, when the key 4 is not depressed, the bottom end of the actuator 46 is located slightly above the top face of the frame horizontal section 34.

As the key 4 is depressed as shown with an arrow in FIG. 4, the actuator 46 lowers through the slot 39 of the frame 3 and comes into pressure contact with the switching section 14*a* of the movable contact 14. Due to resiliency of the material, the contact portion of the switching section 14*a* is thrusted down for provisional deformation with the bottom electrode 16, which is thereby brought into contact with the electrodes 12*a* and 12*b* of the corresponding fixed contact 12. In this way, the fixed contact 12 corresponding to the depressed key 4 is closed.

Figure 5A:
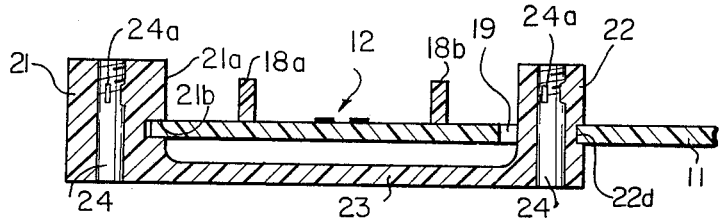

One modification of the foregoing holder block 2 in accordance with the present invention is shown in FIG. 5A, in which the second holding section 22 is provided with a horizontal groove 22*d* on the side opposite to the first holding section 21 and the edge of the base board 11 defining the aperture 19 is snugly received in the horizontal groove 22*d* so that the printed circuit base board 11 is firmly and stably coupled to the holder block 2. The rim 22*a*, the locking projection 22*b* and the arm 22*c* used in the first embodiment are all omitted in this case.

Figure 5B:
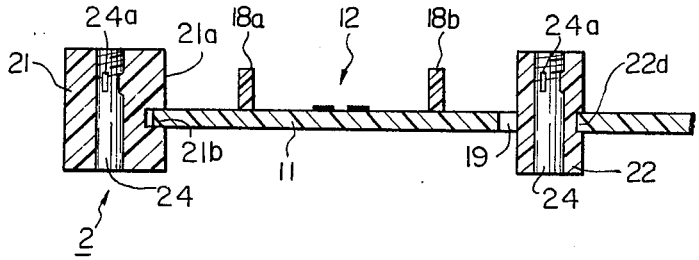
Figure 5C:
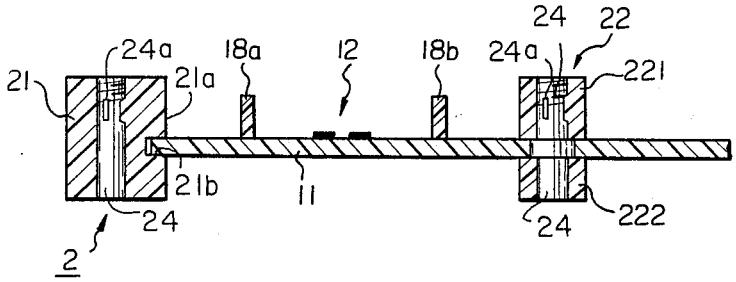

In the case of the holder block 2 shown in FIG. 5B, the connecting section 23 used in the foregoing embodiments is omitted and the holding sections 21 and 22 are formed as separate bodies which are coupled to each other by the printed circuit base board 11. The mode of coupling the base board 11 with the second holding section 22 is the same as that shown in FIG. 5A. In constructing the keyboard assembly with this holder block 2, the first and second holding sections 21 and 22 are separately mounted on the frame 3 by means of the set screws 6, the movable contact 14 is coupled to the printed circuit base block 11, and the key switch unit 1 so assembled is coupled to the holder block 2, i.e. the first and second holding blocks 21 and 22, already fixed to the frame 3.

in the case of the holder block 2 shown in FIG. 5*c*, the second holding section 22 comprises a pair of upper and lower pieces 221 and 222 and the base board 11 is provided with an aperture 11*a* for idle passage of the set screw 6 (see FIG. 4). The base board 11 is firmly clamped between the holding section pieces 221 and 222 when the set screws 6 are fastened. The upper holding section piece 221 may be advancedly fixed to the bottom face of the frame horizontal section 34 by bonding.

Figure 5D:
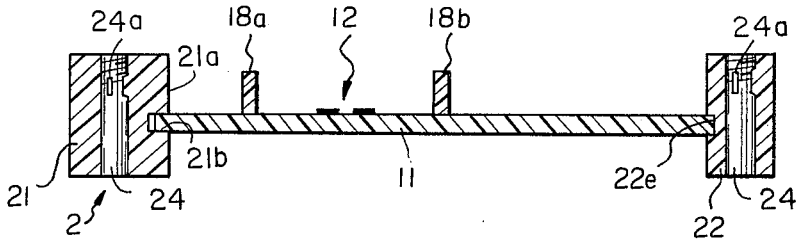

The modification shown in FIG. 5D is provided with the second holding section 22 which has a horizontal groove 22*e* on the side close to the first holding section 21 and the end of the base board 11 opposite to the first holding section 21 is snugly received in the horizontal groove 22*e*. In the case of this embodiment, the second holding section 22 may be elongated over the entire length of the base board 11. Alternatively, each of a plurality of second holding sections 22 may be elongated over proper partial length of the base board 11.

Figure 6:
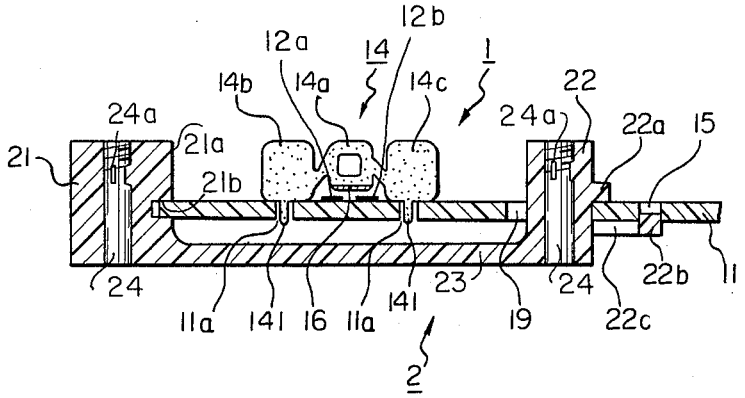
FIG. 6 is a side sectional view of one modified embodiment of the key switch unit used for the keyboard assembly in accordance with the present invention.

One modified embodiment of the key switch unit 1 in accordance with the present invention is shown in FIG. 6, in which apertures 11*a* are formed in the printed circuit base board 11 at positions below the holding sections 14*b* and 14*c* of the movable contact 14 and projections 141 are formed on the bottom faces of the holding sections 14*b* and 14*c*. In the assembled state of the key switch unit 1, the bottom projections 141 of the movable contact 14 are inserted into the apertures 11*a* of the base board 11 so that the electrode 16 on the switching section 14*a* is maintained in position above the fixed contact 12 on the printed circuit base board 11. As the key 4 is depressed, the actuator 46 forces down the movable contact switching section 14*a* and the electrode 16 is placed in contact with the electrodes 12*a* and 12*b* in order to close the fixed contact 12. This key switch unit 1 is assembled together with the holder block 2 same with the one shown in FIG. 3 in a manner same with that shown in FIG. 2.

Figure 7:
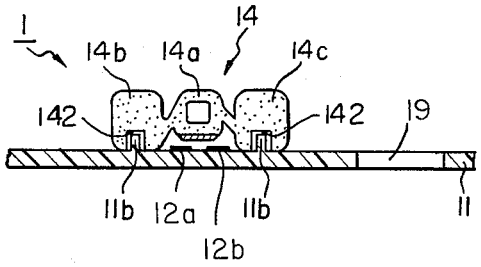
FIG. 7 is a fragmentary side sectional view of another modified embodiment of the key switch unit used for the keyboard assembly in accordance with the present invention.

Another modified embodiment of the key switch unit 1 in accordance with the present invention is shown in FIG. 7, in which recesses 142 are formed in the bottom faces of the movable contact holding sections 14*b* and 14*c* and projections 11*b* are formed on the top face of the printed circuit base board 11. In the assembled state of the key switch unit 1, the top projections 11*b* of the base board 11 are received in the bottom recesses 142 of the movable contact so that the electrode 16 on the switching section 14 is maintained in position above the fixed contact 12 on the printed circuit base block 11.

Figure 8:
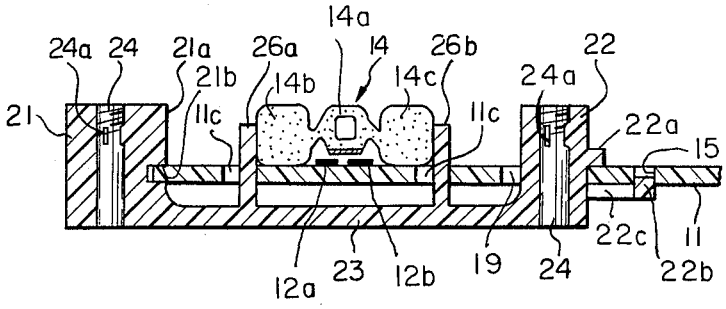
FIG. 8 is a side sectional view of other embodiments of the key switch unit and the holder block in the assembled state, which are used for the keyboard assembly in accordance with the present invention.
Figure 9:
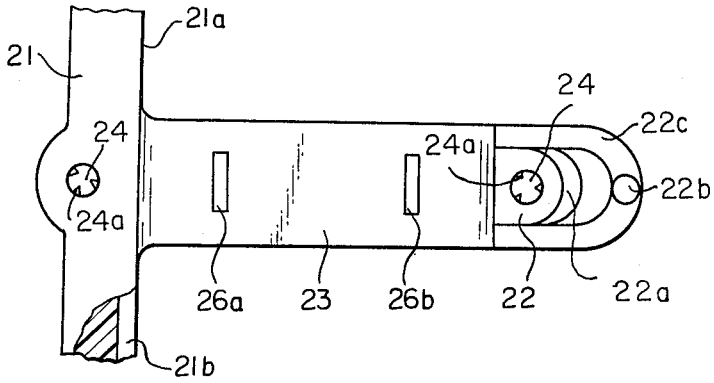
FIG. 9 is a plan view, partly in section, of another embodiment of the holder block in accordance with the present invention.

FIGS. 8 and 9 depict another embodiment of the holder block 2 which, like the holder block 2 shown in FIGS. 2 and 3, includes the first and second holding sections 21 and 22 and the connecting sections 23. The holding block 2 further includes a pair of holding walls 26*a* and 26*b* which extend upwards from the top face of its connecting section 23.

The first holding section 21 is provided with a vertical face 21*a* which extends almost over the entire length of the printed circuit base board 11. A horizontally elongated groove 21*b* is formed in the vertical face 21*a* of the first holding section 21, which has a width almost equal to the thickness of the printed circuit base board 11.

Each second holding section 22 takes the form of a vertical column which is almost semi-circular in transverse cross section and coupled to the vertical face 21*a* via one of the connecting sections 23. A peripheral rim 22*a* is formed on the side of the second holding section 22 opposite to the first holding section 21. At a position somewhat below the rim 22*a*, a U-shaped arm 22*c* extends outwards from the second holding section 22 and carries a locking projection 22*b* formed on the top face thereof. A plurality of second holding sections 22 are provided along the length of the first holding section 21 at properly selected intervals. A pair of threaded holes 24 are formed vertically through the holding sections 21 and 22 in alignment to each other. Small vertical projections 24*a* are formed in each threaded holes 24 in order to stably clamp the set screws 6 when the holder block 2 is coupled to the keyboard assembly.

The printed circuit base board 11 is provided on both sides of each fixed contact 12 with a pair of like apertures 11*c* for idle passage of the holding walls 26*a* and 26*b* of the holder block 2 when the latter is coupled to the key switch unit 1.

In the assembled state of the key switch unit 1, the top portions of the holding walls 26*a* and 26*b* of the holder block 2 project beyond the top face of the printed circuit base board 11 through the apertures 11*c* of the latter and the movable contact 14 is forcedly placed in position between the projecting top portions of the holding walls 26*a* and 26*b*.

A plurality of second holding sections 22 and the first and second holding walls 26*a* and 26*b* are provided alongth the length of the first holding section 21 at properly selected intervals.

Figure 10A:
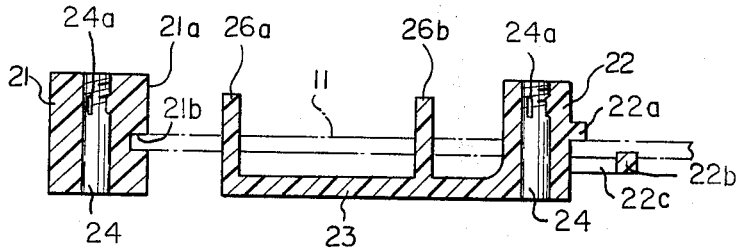
FIGS. 10A and 10B are side sectional views of modifications of the holder block shown in FIGS. 8 and 9.

One modification of the foregoing holder block 2 in accordance with the present invention is shown in FIG. 10A, in which the portion of the connecting section 23 between the first holding section 21 and the first holding wall 26*a* is omitted. In other words, the holding sections 21 and 22 are formed as separate bodies which are coupled to each other by the printed circuit base board 11.

Figure 10B:
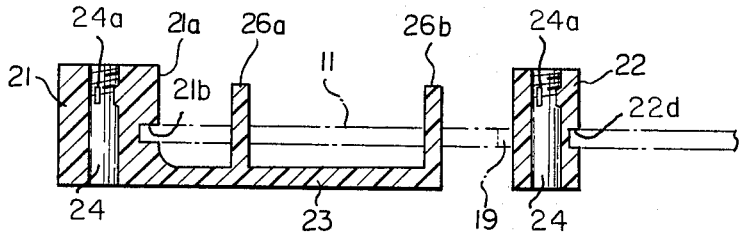

Oppositely in the construction of the holder block 2 shown in FIG. 10B, the portion of the connecting section 23 between the second holding wall 26*b* and the second holding section 22 is omitted. The second holding sections 22 are disconnected from the remainder of the holding block 2 but coupled thereto by means of the printed circuit base board 11 when the key switch unit 1 is assembled with the holder block 2. Like the embodiment shown in FIG. 5A, the second holding section 22 is provided with a horizontal groove 22*d* on the side opposite to the first holding section 21 and the fringe of the base board 11 defining the aperture 19 for the second holding section 22 is snugly received in the horizontal groove 22*d* so that the printed circuit base board 11 is firmly and stably coupled to the holder block 2.

One modification of the holder block 2 shown in FIG. 10B is obtained by making up the second holding section 22 of a pair of upper and lower pieces just like the construction shown in FIG. 5C. In this case, the base board 11 is provided with an aperture for idle passage of the set screw 6 (see FIG. 4). The base board 11 is firmly clamped between the holding section pieces when the set screws 6 are fastened.

In the other modification of the holder block 2 shown in FIG. 10B, the second holding section 22 is provided with a horizontal groove on the side closer to the first holding section 21 and the end of the base board 11 opposite to the first holding section 21 is snugly received in the horizontal groove just as in the construction shown in FIG. 5D. In the case of this embodiment, the second holding section 22 may be elongated over the entire length of the base board 11. Each of a plurality of second holding sections 22 may alternatively be elongated over proper partial length of the base board 11.

Figure 11:
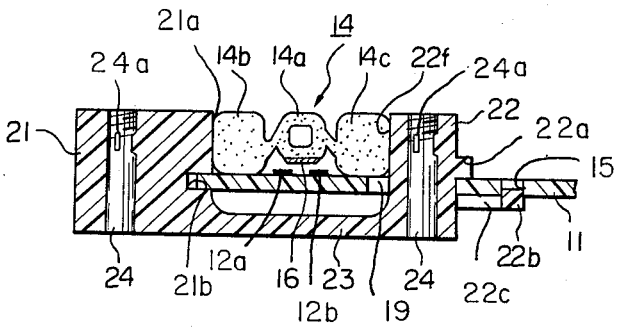
FIG. 11 is a side sectional view of other embodiments of the key switch unit and the holder block in the assembled state, which are used for the keyboard assembly in accordance with the present invention.
Figure 12:
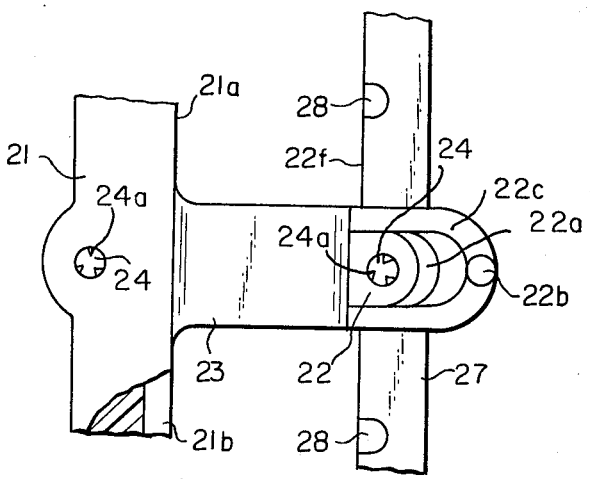
FIG. 12 is a plan view, partly in section, of another embodiment of the holder block in accordance with the present invention.

FIGS. 11 and 12 depict an embodiment of the holder block 2 which, like the holder block 2 shown in FIGS. 2 and 3, includes the first and second holding sections 21 and 22 and the connecting sections 23.

The first holding section 21 is provided with a vertical mating face 21*a* which extends almost over the entire length of the printed circuit base board 11. A horizontally elongated groove 21*b* is formed in the vertical mating face 21*a* of the first holding section 21, which has a width almost equal to the thickness of the printed circuit base board 11.

Each second holding section 22 takes the form of a vertical column which is almost semi-circular in transverse cross section and coupled to the vertical face 21*a* via one of the connecting sections 23. A peripheral rim 22*a* is formed on the side of the second holding section 22 opposite to the first holding section 21. At a position somewhat below the rim 22*a*, a U-shaped arm 22*c* extends outwards from the second holding section 22 and carries a locking projection 22*b* formed on the top face thereof. A plurality of second holding sections 22 are provided along the length of the first holding section 21 at properly selected intervals. A pair of threaded holes 24 are formed vertically through the holding sections 21 and 22 in alignment with each other. Small vertical projections 24*a* are formed in each threaded hole 24 in order to stably clamp the set screws 6 when the holder block 2 is coupled to the keyboard assembly.

The second holding section 22 is provided, on the side closer to the first holding section 21, with a flat vertical face 22*f* adapted for contact with the holding section 14*c* of the movable contact 14. The above-described plurality of second holding sections 22 are connected to each other via a flat horizontal connecting plate 27 which extends substantially parallel to the first holding section 21. On the side facing the first holding section 21, the connecting plate 27 is provided with a plurality of upright auxiliary holding projections 28 adapted for contact with the holding section 14c of the movable contact 14.

So long as the spacer 17 shown in FIG. 1 is not used, the distance between the vertical mating face 21a of the first holding section 21 and the vertical mating face 22f of the second holding section 22 is designed so that, when the movable contact 24 is placed between the two vertical faces 21a and 22a, and no depressing force is applied to the movable contact 14, the bottom electrode 16 of the movable contact 14 is held in position above the electrodes 12a and 12b of the fixed contact 12 on the printed circuit base board 11. When the holder block 2 with the key switch unit 1 is assembled to the frame 3, the holding sections 14b and 14c are clamped between the printed circuit base board 11 and the frame 3, and between the first and second holding sections 21 and 22 of the holder block 2, whereby the movable contact 14 is reliably maintained in the correct position.

Although the foregoing embodiment is provided with a plurality of auxiliary holding projections 28, the projections 28 may be omitted when an appreciable number of second holding sections 22 are provided along the length of the first holding section 21.

Figure 13:
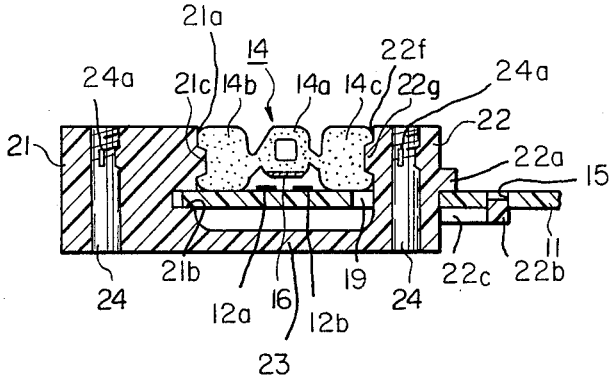
FIG. 13 is a side sectional view of a further embodiment of the key switch unit and the holder block in the assembled state, which are used for the keyboard assembly in accordance with the present invention.
Figure 14:
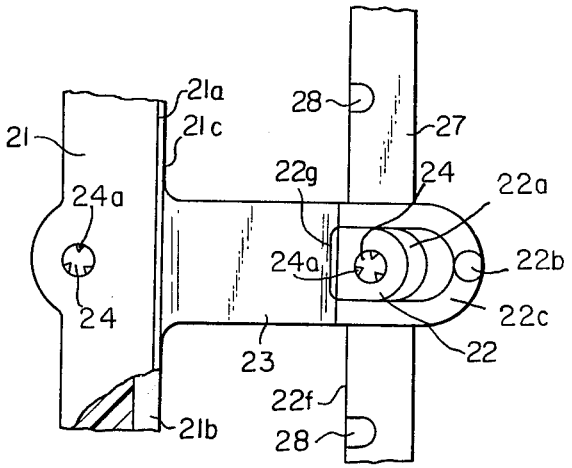
FIG. 14 is a plan view, partly in section, of a further embodiment of the holder block in accordance with the present invention.

One modification of the foregoing holder block 2 in accordance with the present invention is shown in FIGS. 13 and 14, in which the holder block 2 includes the first holding section 21, the second holding sections 22 and, preferably, the auxiliary holding projections 28 arranged on the connecting plate 27. As in the foregoing embodiment, the holding sections 21 and 22 are provided with vertical mating faces 21a and 22f adapted for snug pressure contact with the holding sections 14b and 14c of the movable contact 14.

The vertical mating face 21a is provided with a horizontally elongated groove 21b adapted for engagement with the printed circuit base board 11 and, at a position somewhat above the horizontal groove 21b, a horizontally elongated projection 21c. The vertical mating face 22f is also provided with a horizontally elongated projection 22g.

In contrast to this, the holding sections 14b and 14c are provided in their vertical mating faces with corresponding horizontally elongated grooves.

After the printed circuit base board 11 is assembled with the holder block 2, the movable contact 14 is forcedly placed in position between the holding sections 21 and 22 of the holder block 2, and the horizontal projections 21c and 22g on the holding sections 21 and 22 of holder block 2 are snugly received in the corresponding horizontal grooves in the holding sections 14b and 14c of the movable contact 14 by means of snap coupling.

As the holder block 2 with the key switch unit 1 is assembled to the frame 3 by means of the set screws 6, the movable contact 14 is firmly clamped between the frame 3 and the printed circuit base board 11, and between the holding sections 21 and 22 of the holder block 2.

A modification of the construction shown in FIGS. 13 and 14 is obtained by forming horizontally elongated grooves in the vertical mating faces 21a and 22f of the holding sections 21 and 22 of the holder block 2 and forming corresponding horizontally elongated projections on the vertical mating faces of the holding sections 14b and 14c of the movable contact 14. After the printed circuit base board 11 is assembled with the holder block 2, the movable contact 14 is forcedly placed in position between the holding sections 21 and 22 of the holder block 2, and the horizontal projections on the holding sections 14b and 14c of the movable contact 14 are snugly received in the corresponding horizontal grooves in the holding sections 21 and 22 of the holder block 2.

Figure 15:
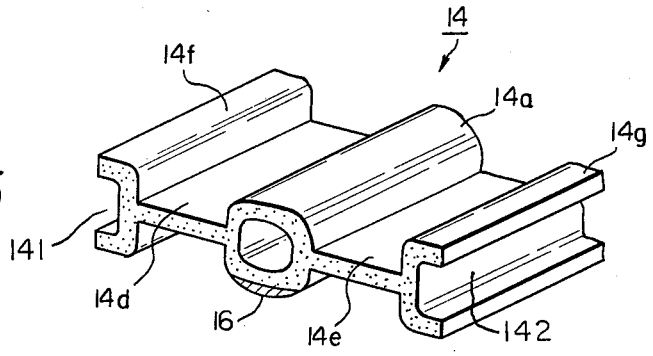
FIG. 15 is a perspective view of a modified embodiment of the movable contact used for the key switch unit in accordance with the present invention.

In the case of the holder block 2 shown in FIGS. 13 and 14, the holding sections 14b and 14c are square in transverse cross section and are provided in the vertical mating faces with horizontally elongated grooves receptive of corresponding horizontally elongated projections on the holder block holding sections 21 and 22. The movable contact 14 shown in FIG. 15 is quite advantageously used for this purpose. The movable contact 14 of this embodiment includes the hollow switching section 14a accompanied by the bottom electrodes 16 and a pair of holding sections 14f and 14g arranged on both sides of the switching section 14a and connected thereto via the connecting sections 14d and 14e. The holding sections 14f and 14g are given in the form of substantially C-shaped channels which are concave outwards, respectively. The outward depressions 141, 142 of the holding sections 14f and 14g are engageable with corresponding horizontally elongated projections 21c and 22g on the holding sections 21 and 22 when the key switch unit 1 is coupled to the holder block 2.

Figure 16:
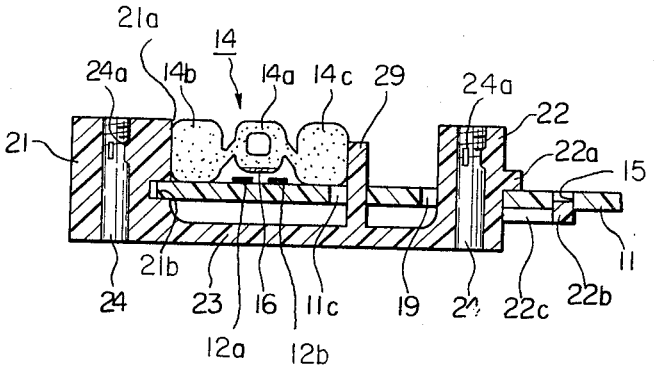
FIG. 16 is a side sectional view of a further embodiment of the key switch unit and the holder block in the assembled state, which are used for the key board assembly in accordance with the present invention.
Figure 17:
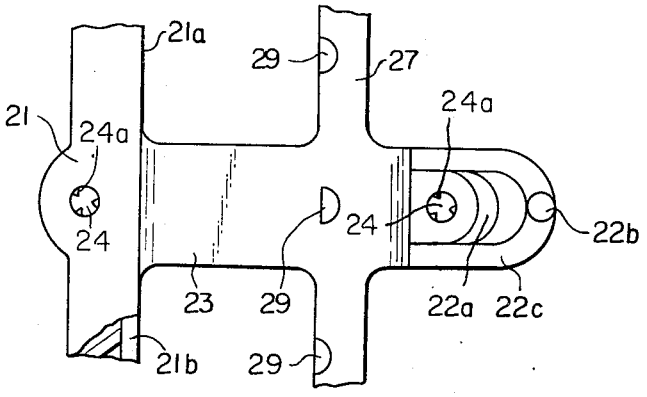
FIG. 17 is a plan view, partly in section, of a further embodiment of the holder block in accordance with the present invention.

FIGS. 16 and 17 depict a further embodiment of the holder block 2 which includes the first and second holding sections 21 and 22, the connecting sections 23 and connecting plates 27 extending substantially parallel to the first holding section 21. The holder block 2 is further provided with a plurality of upright holding projections 29 formed on the connecting plates 27 at properly selected intervals while facing the first holding section 21.

The first holding section 21 is provided with a vertical mating face 21a which extends over the entire length of the printed circuit base board 11. A horizontally elongated groove 21b is formed in the vertical mating face 21a of the first holding section 21, which has a width almost equal to the thickness of the printed circuit base board 11.

Each second holding section 22 takes the form of a vertical column which is almost semi-circular in transverse cross section and coupled to the vertical face 21a via one of the connecting sections 23. A peripheral rim 22a is formed on the side of the second holding section 22 opposite to the first holding section 21. At a position somewhat below the rim 22a, a U-shaped arm 22c extends outwards from the second holding section 22 and carries a locking projection 22b formed on the top face thereof. A plurality of second holding sections 22 are provided along the length of the first holding section 21 at properly selected intervals. A pair of threaded holes 24 are formed vertically through the holding sections 21 and 22 in alignment to each other. Small vertical projections 24a are formed in each threaded holes 24 in order to stably clamp the set screws 6 when the holder block 2 is coupled to the keyboard assembly.

The key switch unit 1 is constructed by coupling the printed circuit base board 11 with the holder block 2 so that the holding projections 29 project over the top face of the base board 11 via apertures 11c, and by forcedly placing the movable contact 14 between the first holding section 21 and the holding projections 29 of the holder block 2.

In a modification of the foregoing embodiment, the portion of the connecting section 23 between the holding projections 29 and the second holding sections 22 is omitted, as in the construction shown in FIG. 10B. The second holding sections 22 are disconnected from the remainder of the holding block 2 but coupled thereto by means of the printed circuit base board 11 when the key switch unit 1 is assembled with the holder block 2. Each second holding section 22 is provided with a horizontal groove on the side opposite to the first holding section 21 and the fringe of the base board 11 defining the aperture 19 for the second holding section 22 is snugly received in the horizontal groove so that the printed circuit base board 11 is firmly and stably coupled to the holder block 2.

In a further modification of the holder block 2 shown in FIGS. 16 and 17, the second holding section 22 is made up of a pair of upper and lower pieces as in the construction shown in FIG. 5C. In this case, the base board 11 is provided with an aperture for idle passage of the set screw 6 (see FIG. 4). The base board 11 is firmly clamped between the holding section pieces when the set screws 6 are fastened.

In a further modification of the holder block 2 shown in FIGS. 16 and 17, the second holding section 22 is provided with a horizontal groove on the side closer to the first holding section 21 and the end of the base board 11 opposite to the first holding section 21 is snugly received in the horizontal groove as in the construction shown in FIG. 5D. In the case of this embodiment, the second holding section 22 may be elongated over the entire length of the base board 11. Alternatively, each of a plurality of second holding sections 22 may be elongated over a respective proper part of the length of the base board 11.

Figure 18:
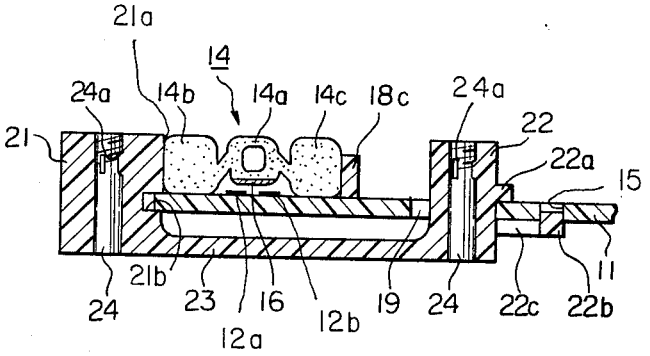
FIG. 18 is a side sectional view of a further embodiment of the key switch unit and the holder block in the assembled state, which are used for the keyboard assembly in accordance with the present invention.

FIG. 18 depicts a further embodiment of the key switch unit 1 and the holder block 2. In this case, the printed circuit base board 11 is provided with an upright holding wall **18*c* which may be either fixed to the top face of the base board 11 by bonding or formed in one intergral body with the base board 11**.

The holder block 2 in this embodiment includes the first and second holding sections 21 and 22, and the connecting sections 23.

The first holding section 21 is provided with a vertical mating face **21*a* which extends over the entire length of the printed circuit base board 11 and is adapted for neat contact with the movable contact 14. A horizontally elongated groove 21*b* is formed in the vertical mating face 21*a* of the first holding section 21, which has a width equal to the thickness of the printed circuit base board 11**.

Each second holding section 22 takes the form of a vertical column which is almost semi-circular in transverse cross section and coupled to the vertical mating face **21*a* via one of the connecting sections 23. A peripheral rim 22*a* is formed on the side of the second holding section 22 opposite to the first holding section 21. At a position somewhat below the rim 22*a*, a U-shaped arm 22*c* extends outwards from the second holding section 22 and carries a locking projection 22*b* formed on the top face thereof. A plurality of second holding sections 22 are provided along the length of the first holding section 21 at properly selected intervals. A pair of threaded holes 24 are formed vertically through the holding sections 21 and 22 in alignment with each other. Small vertical projections 24*a* are formed in each threaded holes 24 in order to stably clamp the set screws 6 when the holder block 2** is coupled to the keyboard assembly.

In order to construct the key switch unit 1, the printed circuit base board 11 is coupled with the holder block 2 and the movable contact 14 is forcedly placed between the first holding section 21 of the holder block 2 and the holding wall **18*c* on the base board 11**.

In a modification of the foregoing embodiment shown in FIG. 18, each second holding section 22 is provided with a horizontal groove on the side opposite to the first holding section 21 and the edge of the base board 11 defining the aperture for the second holding section 22 is snugly received in the horizontal groove so that the printed circuit base board 11 is firmly and stably coupled to the holder block 2.

In a further modification of the embodiment of FIG. 18, the second holding section 22 is made up of a pair of upper and lower pieces as in the construction shown in FIG. 5C. In this case, the base board 11 is provided with an aperture for idle passage of the set screw 6 (see FIG. 4). The base board 11 is firmly clamped between the upper and lower pieces of the second holding section 2 when the set screws are fastened.

In a further modification of the holder block 2, the second holding section 22 is provided with a horizontal groove on the side closer to the first holding section 21 and the end of the base board 11 opposite to the first holding section 21 is snugly received in the horizontal groove as in the construction shown in FIG. 5D. In this case, the second holding section 22 may be elongated over the entire length of the base board 11. Alternatively, each of a plurality of second holding sections 22 may be elongated over a respective proper part of the length of the base board.

The following advantages result from employment of the keyboard assembly in accordance with the present invention.

(a) Use of a single movable contact for all keys greatly simplifies construction and assembly of the keyboard assembly. The number of mechanical and electrical parts necessary for construction of the keyboard assembly is greatly reduced, which leads to a remarkable decrease in the production cost.

(b) Use of the resilient movable contact assures ideal engagement of the movable contact with the fixed contacts, thereby successfully avoiding generation of undesirable chattering during performance of the electronic musical instruments.

(c) Since at least one edge of the printed circuit base board is firmly held by at least one holding section of the holder block, undesirable bending, twisting, waving and deformation of the printed circuit base board can be prevented.

(d) Firm holding of the movable contact by cooperation of any selected two of the base board holding walls, the projection-aperture combinations, the holder block holding walls, the holder block holding sections and the holder block holding projections enables maintenance of the movable contact electrodes in position above the fixed contact electrodes in position above the fixed contact electrodes when no depression is applied to the keys even when no spacer is arranged therebetween.

(e) The key switch unit can be assembled in one body with the holder block in advance of incorporation into the keyboard assembly.

(f) Combination of the key switch unit with the holder block can be carried out simply by snap coupling only and no use of special tools is required for this purpose.

(g) Since the switching section of the movable contact carrying the electrodes is held on both sides by the holding sections extending over the entire length of the switching section, undesirable downward bending or twisting of the switching section can be successfully avoided and, therefore, the movable contact electrodes can be maintained in position over the fixed contact electrodes quite uniformly for all keys.

(h) Use of a single movable contact common to all keys enables use of the printed circuit, which greatly contributes to compact construction of the entire system even when the circuit is complicated.

(i) By adjusting the mounting of the single movable contact with respect to its cooperating parts, uniform adjustment of inter-electrode alignment is effected for all keys.

I claim:

1. An improved keyboard assembly for electronic musical instruments, comprising:

a keyboard frame carrying a first plurality of independently swingable keys arranged in side-by-side relationship to each other, each of which is provided with a downwardly projecting actuator;

holder block means including first and second holding sections;

a printed circuit base board carried by said holder block means having a top face on which is printed a given electric circuit including a second plurality of sets of fixed contacts, said sets being equal in number to said first plurality of keys, said sets being arranged in spaced side-by-side relationship to each other at intervals corresponding to those of said keys such that each of said sets is associated with a respective one of said keys;

a movable contact made of a resilient material and including a center switching section which extends over all of said fixed contacts, said switching section having a bottom surface which faces said fixed contacts, and said movable contact further including electrode means disposed on said bottom surface of said switching section; and said movable contact further including a pair of holding sections which are arranged on opposite sides of and connected to said center switching section; and means for maintaining said movable contact in position relative to said printed circuit base board so that said movable contact electrode means is held in position above and spaced from said fixed contacts when none of said keys is depressed and so that when a key is depressed, a corresponding portion of said movable contact electrode means is locally brought into contact with its respective set of fixed contacts.

2. An improved keyboard assembly as claimed in claim 1, further comprising an elongated spacer made of an electrically non-conductive material, disposed on said printed circuit base board between said movable contact center switching section and said fixed contacts, and having apertures at positions corresponding respectively to each of said sets of fixed contacts for permitting electrical contact to be made therethrough between a given one of said sets of fixed contacts and the corresponding one of said keys when the latter is depressed.

3. An improved keyboard assembly as claimed in claim 1 or 2, in which said first holding section has a side facing said second holding section, said side being provided with an elongated groove which tightly receives a corresponding edge of said printed circuit base board.

4. An improved keyboard assembly as claimed in claim 1, in which said maintaining means includes a pair of holding walls which stand generally upright on said top face of said printed circuit base board, extend substantially parallel to said first holding section over the entire length of said movable contact, and are spaced from each other, said fixed contacts being between said holding walls.

5. An improved keyboard assembly as claimed in claim 4, further comprising a connecting section joining said first and second holding sections to each other integrally, said connecting section being located below said printed circuit base board; said printed circuit base board having apertures therein through which said second holding sections idly project, and having additional apertures therein for engaging said second holding sections; and each of said second holding sections being provided with a peripheral rim in contact with said top face of said printed circuit base board, an arm horizontally projecting from a position below said peripheral rim, and a locking projection carried by said arm and received in a respective one of said additional apertures in said printed circuit base board.

6. An improved keyboard assembly as claimed in claim 4, in which said first and second holding sections are coupled in one body to each other by a third section located below said printed circuit base board; and in which said printed circuit base board is provided with apertures through which said second holding sections idly project over said top face of said printed circuit base board; and in which said holder block means comprises a plurality of said second holding sections, each of said second holding sections having a side facing away from said first holding section and being provided on said side facing away from said first holding section with a horizontal groove which tightly receives an edge of said printed circuit base board.

7. An improved keyboard assembly as claimed in claim 4, in which said holder block means comprises a plurality of said second holding sections, said printed circuit base board being provided with apertures through which said holder block second holding sections idly project over said top face of said printed circuit base board, and each of said holder block second holding sections having a side facing away from said first holding section and being provided on said side facing away from said first holding section with a horizontal groove which tightly receives an edge of said printed circuit base board.

8. An improved keyboard assembly as claimed in claim 4, in which said holder block means comprises a plurality of said second holding sections, each of said second holding sections comprising a pair of upper and lower pieces which vertically clamp said printed circuit base board in place, and said printed circuit being provided at positions corresponding to said second holding sections with apertures for idle passage of said second holding sections.

9. An improved keyboard assembly as claimed in claim 4, in which said holder block means comprises a plurality of said second holding means, each of said second holding sections having a side facing said first holding section and being provided on said side facing said first holding section with a horizontal groove which tightly receives an edge of said printed circuit base board.

10. An improved keyboard assembly as claimed in claim 1, in which said movable contact holding sections have respective bottom faces, and said maintaining means includes projections formed on said bottom faces of said movable contact holding sections, and in which said printed circuit base board is provided with apertures in which said movable contact projections are received.

11. An improved keyboard assembly as claimed in claim 1, in which said maintaining means includes top projections formed on said printed circuit base board, and said movable contact holding sections are provided with bottom recesses which receive said base board top projections.

12. An improved keyboard assembly as claimed in claim 1, in which said holder block means comprises a plurality of said second holding sections, and in which said holder block means further includes a plurality of third sections located between said first and second holding sections below said printed circuit base board and coupled to at least one of said two holding sections, said third sections having respective top faces, and in which said maintaining means includes a plurality of paired holding walls standing generally upright on said top faces of said third sections, each pair of said paired holding walls extending substantially parallel to said first holding section and being spaced from each other on both sides of said fixed contacts, and in which said printed circuit base board is provided with apertures through which said holding walls project over said top face of said base board.

13. An improved keyboard assembly as claimed in claim 12, in which said printed circuit base board is provided with apertures through which said second holding sections idly project over said top face of said printed base board and with additional apertures, and in which each of said second holding sections is provided with a peripheral rim in contact with said top face of said printed circuit base board, an arm horizontally projecting from a position below said peripheral rim, and a locking projection carried by said arm and received in respective ones of said additional apertures.

14. An improved keyboard assembly as claimed in claim 13, in which said holder block first and second holding sections are coupled in one body to each other by said third sections.

15. An improved keyboard assembly as claimed in claim 13, in which said third sections are coupled to said second holding sections only.

16. An improved keyboard assembly as claimed in claim 12, in which said third sections are coupled to said first holding section only.

17. An improved keyboard assembly as claimed in claim 16, in which said printed circuit base board is provided with apertures through which said second holding sections idly project over said top face of said printed circuit base board, and each of said second holding sections has a side facing away from said first holding section and is provided on said side facing away from said first holding section with a horizontal groove which tightly receives an edge of said printed circuit base board.

18. An improved keyboard assembly as claimed in claim 16, in which each of said second holding sections comprises a pair of upper and lower pieces which vertically clamp said printed circuit base board, and in which said printed circuit is provided, at positions corresponding to said second holding sections, with apertures for idle passage of said second holding sections.

19. An improved keyboard assembly as claimed in claim 16, in which each of said second holding sections has a side facing said first holding section and is provided on said side facing said first holding section with a horizontal groove which tightly receives an edge of said printed circuit base board.

20. An improved keyboard assembly as claimed in claim 1, in which said holder block means comprises a plurality of said second holding sections, and in which said holder block further includes a plurality of third sections connecting said first and second holding sections below said printed circuit base board, and in which said maintaining means includes a mating face formed on said first holding section and a plurality of mating faces formed on said second holding sections and facing said first mating face, and in which said printed circuit base board is provided with apertures through which said holder block second holding sections project over said top face of said base board.

21. An improved keyboard assembly as claimed in claim 20, in which said printed circuit base board has a plurality of additional apertures therein, each of said second holding sections is provided with a peripheral rim in contact with said top face of said printed circuit base board, an arm horizontally projecting from a position below said peripheral rim, and a locking projection carried by said arm and received in a respective one of said additional apertures.

22. An improved keyboard assembly as claimed in claim 20, in which said holder block means further includes connecting plates which extend generally parallel to said first holding section and which connect neighboring ones of said second holding sections to each other, and in which said maintaining means further includes a plurality of auxiliary holding projections formed on said connecting plates.

23. An improved keyboard assembly as claimed in claim 20, 21 or 22, in which said mating faces of said holding sections are provided with horizontally elongated projections.

24. An improved keyboard assembly as claimed in claim 23, in which said movable contact holding sections are provided with horizontally elongated grooves which engage said holder block projections.

25. An improved keyboard assembly as claimed in claim 23, in which said movable contact holding sections define substantially C-shaped channels which are concave toward said first and second holding sections, respectively, and in which said channels engage said holder block projections.

26. An improved keyboard assembly as claimed in claim 20, 21 or 22, in which said mating faces of said holding sections are provided with horizontally elongated grooves, and in which said movable contact holding sections are provided with horizontally elongated projections which engage said movable contact grooves.

27. An improved keyboard assembly as claimed in claim 1, in which said holder block means comprises a plurality of said second holding sections, and in which said holder block means further includes a plurality of third sections located between said first and second holding sections below said printed circuit base board and coupled to at least one of said first and second holding sections, and further comprises connecting plates for bridging neighboring ones of said second holding sections; and in said maintaining means includes a mating face formed on said first holding section, and a plurality of holding projections formed on said connecting plates, and in which said printed circuit base board is provided with apertures through which said holder block holding projections project over said top face of said base board.

28. An improved keyboard assembly as claimed in claim 27, in which said printed circuit base board is provided with apertures through which said second holding sections idly project over said top face of said printed circuit base board, and is provided with additional apertures, and in which each of said second holding sections is provided with a peripheral rim in contact with said top face of said printed circuit base board, an arm horizontally extending from a position below said peripheral rim, and a locking projection carried by said arm and received in a respective one of said additional apertures.

29. An improved keyboard assembly as claimed in claim 28, in which said first and second holding sections are coupled in one body to each other by said third sections.

30. An improved keyboard assembly as claimed in claim 28, in which said third sections are coupled to said first holding sections only.

31. An improved keyboard assembly as claimed in claim 30, in which said printed circuit base board is provided with apertures through which said second holding sections idly project over said top face of said printed circuit base board, and in which said printed circuit base board is provided with additional apertures, and in which each of said second holding sections has a side facing away from said first holding section and is provided on said side facing away from said first holding section with a horizontal groove which tightly receives an edge of said printed circuit base board.

32. An improved keyboard assembly as claimed in claim 30, in which each of said second holding sections comprises a pair of upper and lower pieces which vertically clamp said printed circuit base board, and in which said printed circuit is provided at positions corresponding to said second holding sections with apertures for idle passage of said second holding sections.

33. An improved keyboard assembly as claimed in claim 30, in which each of said second holding section has a side facing said first holding section and is provided on said side facing said first holding section with a horizontal groove which tightly receives an edge of said printed circuit base board.

34. An improved keyboard assembly as claimed in claim 1, in which said holder block means comprises a plurality of said second holding sections, and in which said holder block means further includes a plurality of third sections located between said first and second holding sections below said printed circuit base board and coupled to at least one of said holding sections, and in which said maintaining means includes a mating face formed on said first holding section, and a holding wall formed on said printed circuit base board at a location such that said fixed contacts are between said first holding section and said holding wall.

35. An improved keyboard assembly as claimed in claim 34, in which said printed circuit base board is provided with apertures through which said holder block second holding sections idly project over the top face of said printed circuit base board and is further provided with additional apertures, and in which each of said second holding sections is provided with a peripheral rim in contact with said top face of said printed circuit base board, and arm horizontally extending from a position below said peripheral rim, and a locking projection carried by said arm and received in a respective one of said additional apertures.

36. An improved keyboard assembly as claimed in claim 35, in which said third sections are coupled to said first holding sections only.

37. An improved keyboard assembly as claimed in claim 35, in which said third sections are coupled to said second holding sections only.

38. An improved keyboard assembly as claimed in claim 37, in which said printed circuit base board is provided with apertures through which said second holding sections idly project over said top face of said printed circuit base board, and is further provided with additional apertures, and in which each of said second holding sections has a side facing away from said first holding section and is provided on said side facing away from said first holding section with a horizontal groove which tightly receives an edge of said printed circuit base board.

39. An improved keyboard assembly as claimed in claim 37, in which each of said second holding sections comprises a pair of upper and lower pieces which vertically clamp said printed circuit base board, and in which said printed circuit is provided, at positions corresponding to said second holding sections, with apertures for idle passage of said second holding sections.

40. An improved keyboard assembly as claimed in claim 37, in which each of said second holding sections has a side facing said first holding section and is provided on said side facing said first holding section with a horizontal groove which tightly receives an edge of said printed circuit base board.

* * * * *